US010113426B2

(12) United States Patent
Eisner

(10) Patent No.: US 10,113,426 B2
(45) Date of Patent: Oct. 30, 2018

(54) STATOR FOR AN ECCENTRIC SCREW PUMP

(71) Applicant: Korbinian Eisner, Ampfing (DE)

(72) Inventor: Korbinian Eisner, Ampfing (DE)

( * ) Notice: Subject to any disclaimer, the term of this patent is extended or adjusted under 35 U.S.C. 154(b) by 251 days.

(21) Appl. No.: 14/889,399

(22) PCT Filed: Apr. 9, 2014

(86) PCT No.: PCT/EP2014/057149
§ 371 (c)(1),
(2) Date: Nov. 5, 2015

(87) PCT Pub. No.: WO2014/180621
PCT Pub. Date: Nov. 13, 2014

(65) Prior Publication Data

US 2016/0084085 A1 Mar. 24, 2016

(30) Foreign Application Priority Data

May 6, 2013 (DE) ..... 20 2013 004 219 U

(51) Int. Cl.
*F01C 1/10* (2006.01)
*F04C 2/107* (2006.01)
*F04C 18/107* (2006.01)

(52) U.S. Cl.
CPC ..... *F01C 1/101* (2013.01); *F04C 2/1075* (2013.01); *F04C 18/1075* (2013.01); *F05C 2253/04* (2013.01)

(58) Field of Classification Search
CPC ..... F01C 1/101; F04C 2/1075; F04C 2/1071; F04C 18/1075
See application file for complete search history.

(56) References Cited

U.S. PATENT DOCUMENTS

| | | | | |
|---|---|---|---|---|
| 3,514,238 | A | 5/1970 | Smith | |
| 4,211,521 | A * | 7/1980 | Streicher | F04C 2/1075 418/149 |
| 5,807,087 | A * | 9/1998 | Brandt | F04C 2/1075 418/153 |
| 6,102,681 | A | 8/2000 | Turner | |
| 6,162,032 | A | 12/2000 | Jäger | |
| 2007/0140882 | A1 | 6/2007 | Kachele | |
| 2012/0148432 | A1 | 6/2012 | Butuc et al. | |
| 2016/0003244 | A1* | 1/2016 | Strelow | F04C 2/1075 418/206.1 |

FOREIGN PATENT DOCUMENTS

| | | | |
|---|---|---|---|
| CN | 2345737 | Y | 10/1999 |
| CN | 1993551 | A | 7/2007 |

(Continued)

OTHER PUBLICATIONS

Definition of tube from Dictionary.com, printed Feb. 3, 2018.*

*Primary Examiner* — Mary A Davis
(74) *Attorney, Agent, or Firm* — Seager, Tufte & Wickhem, LLP

(57) ABSTRACT

A stator (10) for a feed pump, in particular for an eccentric screw pump, wherein the stator (10) comprises a stator body (18) having an accommodation hole (36) for accommodating a rotor (24). It is further provided that the stator body (18) is configured as an elastomer body (20) reinforced at least in sections with a thread inlay (38).

16 Claims, 7 Drawing Sheets

(56) References Cited

FOREIGN PATENT DOCUMENTS

| | | | |
|---|---|---|---|
| CN | 202091195 | U | 12/2011 |
| DE | 19804259 | A1 | 8/1999 |
| DE | 19842754 | A1 | 4/2000 |
| DE | 10338632 | A1 | 3/2005 |
| DE | 102005028818 | B3 | 8/2006 |
| DE | 102006021897 | A1 | 11/2007 |
| DE | 102010000923 | A1 | 7/2011 |
| JP | 2005344587 | A | 12/2005 |
| WO | 9919605 | A1 | 4/1999 |

* cited by examiner

STATOR FOR AN ECCENTRIC SCREW PUMP

CROSS-REFERENCE TO RELATED APPLICATIONS

This application is a National Stage of International Application No. PCT/EP2014/057149, filed Apr. 9, 2014, which claims the benefit of German Patent Application No. 20 2013 004 219.2, filed May 6, 2013, the entire disclosures of which are incorporated herein by reference.

TECHNICAL FIELD

The present invention relates to a stator for a feed pump, in particular for an eccentric screw pump, wherein the stator comprises a stator body having an accommodation hole for accommodating a rotor.

BACKGROUND

Such pump stators are known from the state of the art and described, for example, in document DE 10 2005 028 818 B3. The stator disclosed in this document comprises a stator body made of a casing in the form of a smooth-cylindrical tube of steel and a lining of rubber or a rubber-like synthetic material. The casing of the stator body encompasses the lining and the lining tightly adheres to an inner wall of the casing of the stator body. An inner side of the lining defines an axially continuous cavity.

Document DE 10 2006 021 897 A1 discloses a stator casing having an elastic lining, wherein the stator casing comprises longitudinal grooves on the inside. The ends of the stator casing have a positive-fit connection with a closure strip in order to protect the stator casing from expanding in the pumping mode.

Furthermore, document DE 10 2010 000 923 A1 discloses a stator for an eccentric screw pump whose stator body is formed of a hollow cylindrical casing made of metal and an elastomer core which is firmly bonded to an inner casing surface of the hollow-cylindrical casing by means of vulcanization.

The state of the art also describes stators comprising a helical stator body. Such a stator is disclosed, for example, in document DE 198 04 259 A1. The stator according to this document essentially consists of a rigid casing being made of steel and a lining being made of rubber or a rubber-like synthetic material and being encompassed by the casing. The lining is connected to the casing in a tightly adhering manner, i.e., it contacts the inner side of the casing. The lining has a continuous cavity for accommodating a rotor. The inside and the outside of the casing have the contour and shape of the cavity and accordingly are likewise helical.

The stators known from the state of the art are mostly manufactured according to the scheme disclosed in DE 10 2010 000 923 A1.

According to this document, the stators known from the state of the art are manufactured in that first of all the casing of the stator body is cut to length in the required dimensions from a metal tube or steel tube. Subsequently, the casing of the stator body is chemically and/or mechanically cleaned roughly and thereafter finely as well as roughened in order to enhance the adherence between the casing and the lining made of rubber or a rubber-like synthetic material. Furthermore, the casing must be (chemically) pretreated at the connection site with the rubber such that a connection with the rubber can be effected. For the purpose of producing the helical or spiral hole, a preheated, helical core is inserted into the casing prepared for the firm bonding. Subsequently, the front ends of the casing are closed with lids and a caoutchouc mixture is injected. A connection between the casing and the rubber lining for forming the stator body is effected by a vulcanization of the rubber lining.

This type of production of a pump stator is very time-consuming and cost-intensive, i.a., because of the treatment and pre-treatment of the metal tube.

An object to be achieved with the present invention is the provision of a stator for a feed pump, in particular for an eccentric screw pump, which can be produced in a simple and cost-efficient way.

This object is achieved with a stator for a feed pump of the initially mentioned type in which the stator body is configured as an elastomer body reinforced at least in sections with a thread inlay.

By means of the stator body in the form of an elastomer body reinforced at least in sections with a thread inlay, it is possible to completely do without a metal tube or a firm and non-detachable bonding with a metal tube in the production of the stator for a feed pump. Thus, when producing the stator or rather the stator body for a feed pump, it is thereby possible to save in particular the expenses necessary for procuring and conditioning the metal tube and for its pre-treatment as well as to save the time involved in this connection, i.e. with the stator of the invention it is possible to reduce the production costs to a considerable extent.

Furthermore, the stator body according to the invention can be completely recycled since, in contrast to the usual practice in the state of the art, no non-detachable bonding with metal parts is effected.

When the stator according to the invention is used in a feed pump, such as, for example, an eccentric screw pump, higher torques than with the stators known from the state of the art can be accepted by the stator body constituted by an elastomer body reinforced with a thread inlay. During the operation of a feed pump and in particular during the operation of an eccentric screw pump, the helical rotor extending through the hole in the stator gets into contact with the elastomer core of the stator. Since the rubber lining according to the state of the art is vulcanized onto the tube made of metal, the connection site between the rubber lining and the metal tube represents a weak point of the stators known from the state of the art. When the torque exerted onto the rubber lining is too high, the rubber lining of the state of the art may be severed from the metal tube at the connection site with the metal tube.

This weak point is completely eliminated with the stator according to the invention. In the case of the stator according to the invention, there is no connection site between the rubber and a metal tube since the stator body is made completely and exclusively of an elastomer body into at least sections of which a thread inlay is embedded. In other words, the stator body of the stator according to the invention can move in the radial and also the axial direction since there is no connection to a metal tube. This freedom of motion achieved according to the invention entails that the service life can be extended and downtimes as well as wear as a whole can be reduced.

SUMMARY

According to an embodiment of the invention, the stator body can be configured spiral-shaped or helical. The accommodation hole in the stator body can helically extend through the stator body along the longitudinal axis thereof When such a stator is used with a rotor, the interaction of the rotor and the stator, i.e. the eccentric rotary motion of the rotor in the stator, leads to the formation of two or more separate conveyor chambers which enable a continuous conveyance of the material to be conveyed.

The thread inlay can preferably extend in the longitudinal direction through the stator body. As already mentioned, the thread inlay can be embedded in or encompassed by the elastomer body.

According to an embodiment of the invention, the thread inlay can extend around the longitudinal axis of the stator in the elastomer body in the form of a winding. In this connection, the winding of the thread inlay can preferably consist of several layers. The individual layers of the winding can be wound crosswise. Generally, different thread windings and fabric windings are conceivable as the thread inlay. It is, for example also possible to use single-layer or multi-layer fabric layers, fabric strips or the like. The production of the stator can be further simplified and accelerated by means of the fabric strips since they can be rapidly and simply wound on a first elastomer layer during the production.

According to an embodiment of the invention, supporting elements can be provided on the stator body on its outer circumferential surface in a way distributed along its longitudinal extension. The supporting elements can be configured and arranged on the elastomer body such that they prevent the elastomer body from bulging or buckling and twisting when the stator is used with a feed pump.

According to a further embodiment of the invention, the stator can comprise at least one tie rod which is connected to the end pieces at the axial ends of the stator body. The at least one tie rod is arranged for locking the stator body against rotation in order that the stator body is not twisted or rotated along with the rotor by the rotation of the rotor when the pump is in operation. Furthermore, tie rods are provided on stators or feed pumps since in the case of such pumps a relatively high pressure is exerted onto the axial end faces of the stator and/or the stator body by the media to be conveyed, which particularly in the case of eccentric screw pumps often may be viscous, highly viscous or abrasive, so that the tie rods prevent the stator and/or components connected to the stator from being deformed.

According to an embodiment of the invention, the supporting elements provided on the outer circumferential surface of the stator body can rest against the at least one tie rod and thus prevent the stator body from twisting as well as buckling or bulging during the operation of a feed pump. The supporting elements can be configured in the form of projections on the outer circumferential surface of the stator body and project in the direction of the tie rods. For providing support, the supporting elements rest on the tie rods with a contact portion formed on them. The tie rods can cooperate with the supporting elements and their contact portions for locking the stator body against rotation and hold the stator body in this way in its predetermined position.

The supporting elements can thus serve as an anti-twist protection. On account of the anti-twist protection achieved by the supporting elements, the preload force of the tie rods can be reduced and the preload force can be reduced to the axial sealing force required in the specific application. Since the tie rods have to generate no or only little axial preload force also on account of the thread inlay of the stator body, the stator can be adjusted to specific pumps and specific applications via the positioning and dimensioning of the tie rods and/or the supporting elements, whereby, i.a., also the performance of such pumps can be increased.

The end pieces of the stator can be preferably configured such that the axial ends of the stator body, which is configured in the form of an elastomer body reinforced with a thread inlay, can be seized by means of the end pieces. By the seizure of the axial ends of the stator body by means of the end pieces connected to each other via the tie rods, the stator body is kept in its predetermined form and the stator can thus be attached via the end pieces to the feed pump and components connected thereto.

According to an embodiment of the invention, the stator body can comprise a retainer portion and an accommodation portion encompassing the accommodation hole, wherein the retainer portion radially surrounds the accommodation portion at least in sections.

It is preferred to use this type of stator in pumps or feed pumps comprising a rigidly supported rotor. In this type of pumps, the eccentric motion for generating the pump chambers must be generated via the stator because, although the helical rotor is rotatable, it is not deflectable in the radial direction for generating an eccentric motion. The eccentric motion necessary for the pumping operation is achieved with this type of pump by the accommodation portion of the stator body which is deflected in operation by the rotating helical rotor and thus can perform an eccentric motion. Two conveyor chambers can be formed between the rotor and the accommodation portion or rather between their corresponding helical contours by means of the deflectable accommodation portion in order to convey the medium to be conveyed through the stator.

The retainer portion and the accommodation portion can be connected to each other via a portion extending at an angle to the longitudinal axis. In contrast to the connection portion, the retainer portion and the accommodation portion can extend in the direction of the longitudinal axis.

A first end of the stator body can be seizable via end pieces of the stator. The second end of the stator body can be radially inwards of the first end. In this case, the two ends of the stator body can be in a plane extending substantially perpendicular to the longitudinal axis.

According to this embodiment, the accommodation portion can have a helical contour.

The present invention further relates to a feed pump comprising a stator of the type as described above.

The present invention also relates to an eccentric screw pump comprising a stator as described above.

BRIEF DESCRIPTION OF THE DRAWINGS

In the following an exemplary embodiment of the present invention is described with reference to the attached drawings, in which.

DETAILED DESCRIPTION

Figure 1:
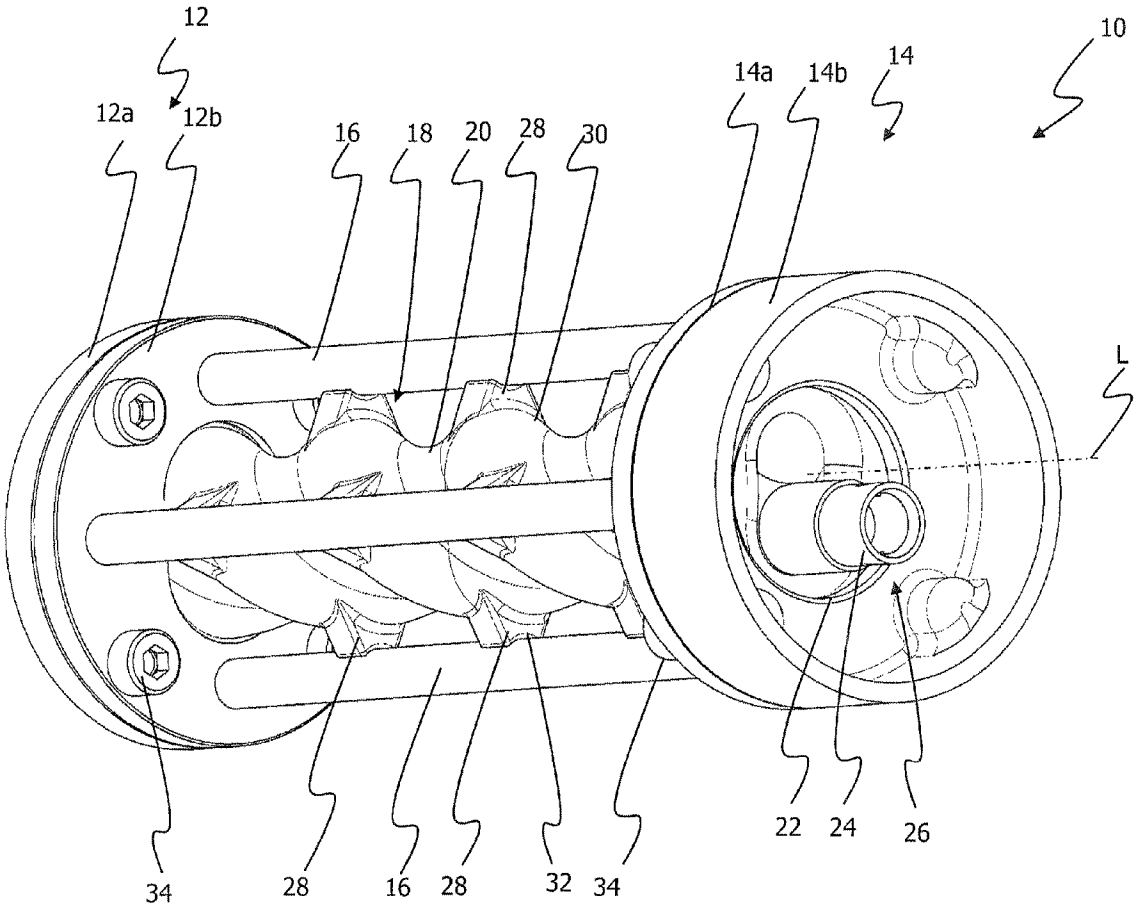
FIG. 1 shows a perspective view of a stator according to a first embodiment of the invention.

FIG. 1 shows a perspective view of a stator for a feed pump which is generally denoted by 10.

The stator 10 comprises end pieces 12 and 14 which are connected to each other via tie rods 16 (three tie rods are shown in FIG. 1). The stator body 18 being configured in the form of an elastomer body 20 being at least in sections reinforced with a fiber inlay (not shown) extends between the end pieces 12 and 14.

According to FIG. 1, the end pieces 12 and 14 are configured as multi-part pieces, which will be dealt with in more detail in the following.

A hole 22 through which an end portion 24 of the rotor 26 extends can be seen in the end piece 14.

The rotor 26 can be connected via the end portion 24 to a drive means (not shown), which may consist, for example, of a motor and a universal-joint shaft. When in operation with a feed pump, the rotor 26 can perform an eccentric and rotary motion. A universal-joint shaft for connecting a motor to the rotor 26 can comprise, for example two cardan joints. Furthermore, the connection between the motor and the rotor 26 can be effected via a flexible bending rod.

FIG. 1 further illustrates supporting elements 28 at the elastomer body 20 or the stator body 18, said supporting elements being distributed on the outer circumferential surface 30 of the stator body 18 around and in the direction of the longitudinal axis L. The rotor body 18 is spiral-shaped or helical, wherein the supporting elements 28 are provided on the outer circumference of the helix shape or spiral shape.

The supporting elements 28 are supported against or rest against the tie rods 16. To this end, the supporting elements 28 have a concave contact portion 32. During the operation of a feed pump provided with the stator 10, the feature that the supporting elements 28 rest against the tie rods 16 entails that the stator body 18 is prevented from buckling or bulging due to the pressure exerted by the medium to be conveyed. In other words, the pressure exerted by the medium to be conveyed onto the elastomer body 20 of the stator body 18 is transmitted to the tie rods via the supporting elements 28 and the supporting elements 28 are deformed.

As further illustrated in FIG. 1, the end pieces 12 and 14 are configured as multi-part pieces and comprise end piece members 12*a*, 12*b* and 14*a*, 14*b*. The end piece members 12*a* and 12*b* are connected to each other via fastening means in the form of screws 34, as depicted in FIG. 1. The same is true for the end piece members 14*a*, 14*b*, which is hinted at in FIG. 1.

Figure 2:
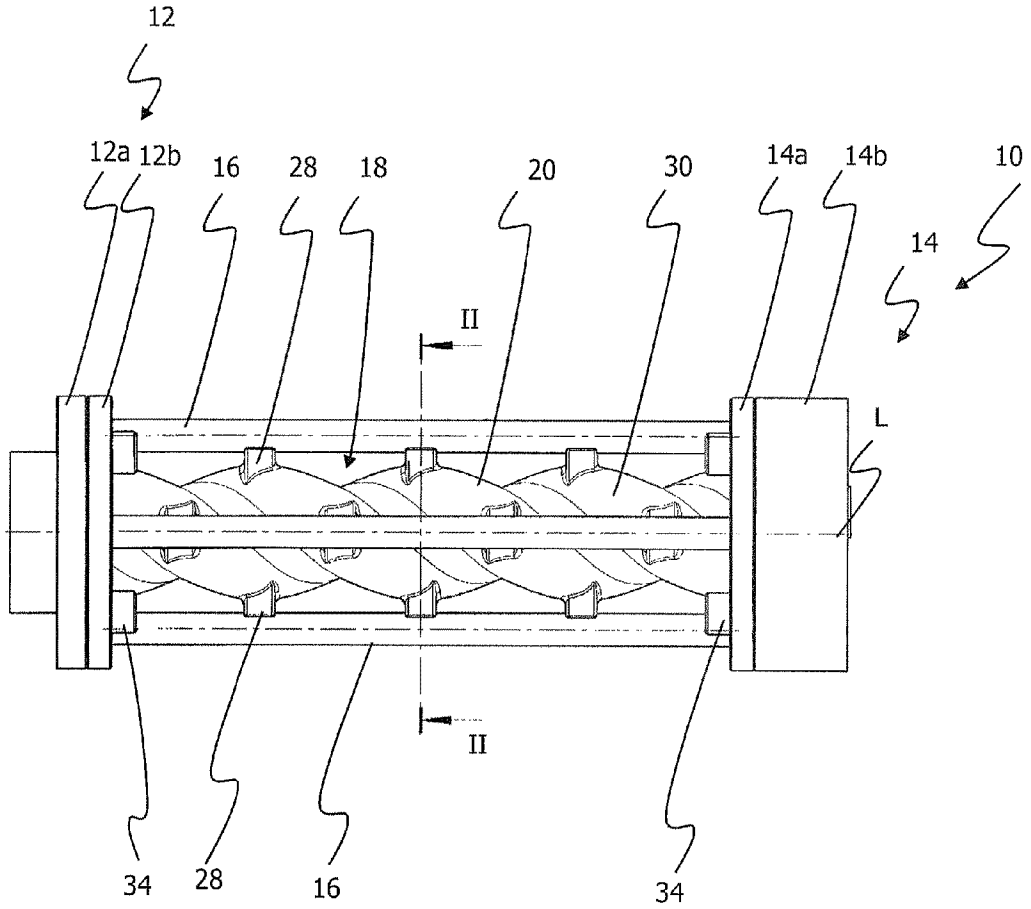
FIG. 2 shows a front view of the stator according to FIG. 1.

FIG. 2 shows a front view of the stator 10.

FIG. 2 depicts the end piece members 12*a* and 12*b* of the end piece 12 as well as the end piece members 14*a* and 14*b* of the end piece 14, which are connected to each other via screws 34 just as the end piece members 12*a* and 12*b*.

FIG. 2 reveals the helical or spiral shape of the stator body 18, wherein the supporting elements 28 are arranged to be distributed over the radius of the helical shape of the stator body 18 in its longitudinal direction. Each of the supporting elements 28 is supported on the tie rods 16 extending between the end pieces 12 and 14.

Figure 3:
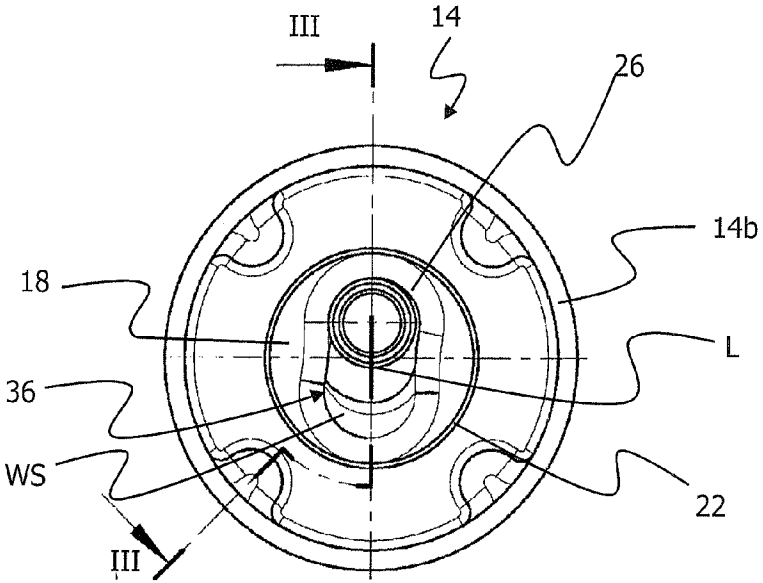
FIG. 3 shows a side view of the stator according to FIGS. 1 and 2.

FIG. 3 shows a side view of the stator 10.

FIG. 3 illustrates the end piece 14 and the pot-like end piece member 14*b* as well as the hole 22 configured therein. The rotor 26 is accommodated in an accommodation hole 36 or in a recess 36 in the stator body 18. The entrance of the hole 36 in the stator body 18 or the elastomer body 20 has an elongate extension transverse to the longitudinal axis in order to enhance the eccentric motion of the rotor 26.

FIG. 3 further shows the helical structure WS of the recess or hole 36 in the direction of the axis L.

Figure 4:
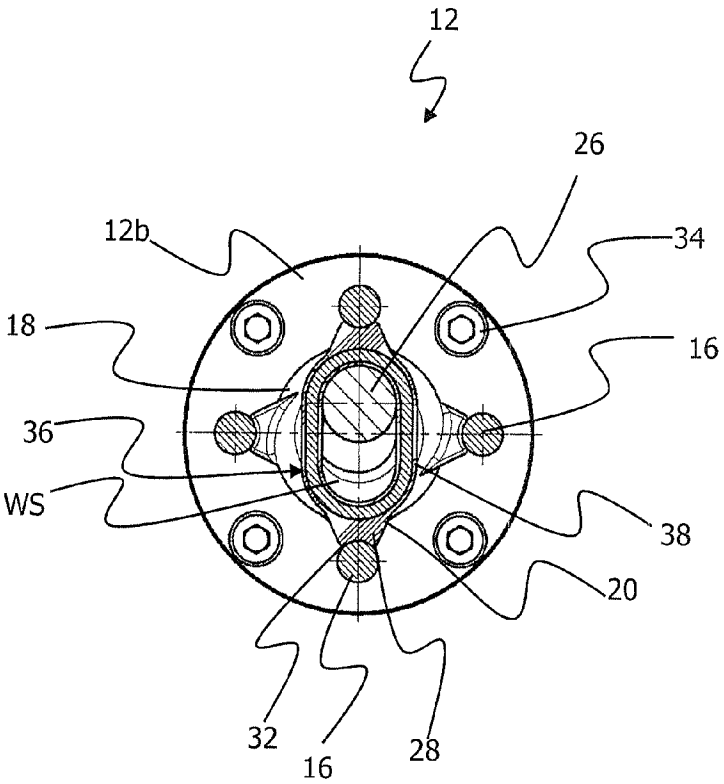
FIG. 4 shows a sectional view along the sectional line II-II of FIG. 2.

FIG. 4 shows a sectional view along the sectional line II-II of FIG. 2.

FIG. 4 illustrates the end piece 12 or rather the end piece member 12*b*, the screws 34 connecting the end piece members 12*a* and 12*b* to each other (FIG. 2) and the rotor 26 extending through the hole 36.

The supporting elements 28 rest against the tie rods 16 via their contact portions 32.

FIG. 4 shows for the first time the thread inlay 38 which is embedded into the elastomer body 20 of the stator body 18 in order to reinforce the elastomer body 20.

In the sectional view according to FIG. 4, the hole 36 in the stator body 18 through which the rotor 24 extends has again an elongate shape due to the spiral or helical shape of the stator body 18.

Figure 5:
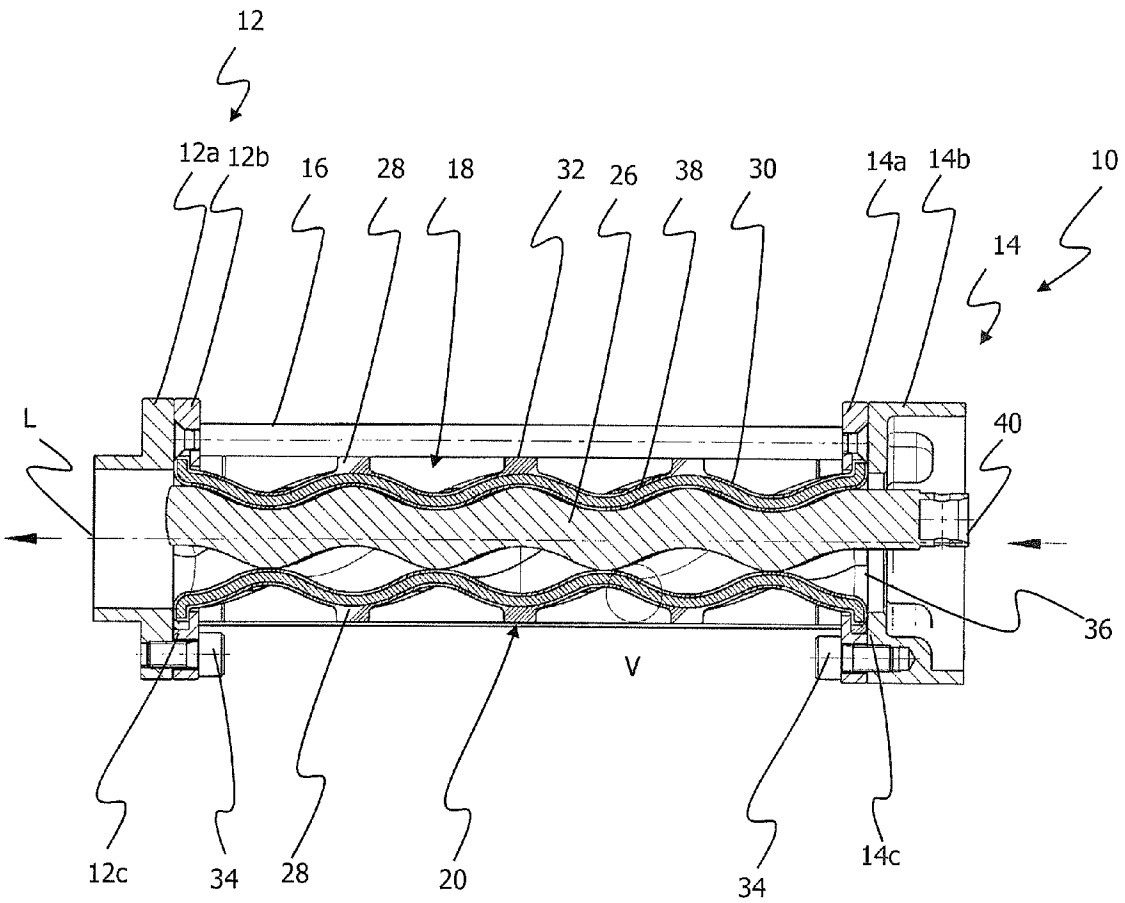
FIG. 5 shows a sectional view along the sectional line III-III according to FIG. 3.

FIG. 5 shows a sectional view along the sectional line of FIG. 3.

Eventually, FIG. 5 clearly depicts the thread inlay 38 which extends in the direction of the longitudinal axis L of the stator 10 through the elastomer body 20 of the stator body 18 and/or is embedded in the elastomer body 20.

The axial ends of the stator body 18 are respectively seized by the end piece members 12*a*, 12*b* and 14*a*, 14*b* in order to fix the stator body 18 to the end pieces 12 and 14 and keep in shape the stator body 18 together with the tie rods 16. Recesses 12*c* and 14*c* accommodating the axial ends of the stator body 18 are provided in the end piece members 12*b* and 14*b* for fixing the axial ends of the stator body 18. The axial ends of the stator body 18 are seized or clamped between the respective end piece members 12*a*, 12*b* and 14*a*, 14*b* via the screws 34.

The hole 36 or the recess 36 extends through the stator body 18 in the direction of the longitudinal axis L thereof The inside of the recess 36 is also provided with a helical or spiral-shaped contour. The rotor 26 in turn extends through the recess 36, as illustrated in FIG. 5. The rotor 26 is likewise spiral-shaped or helical.

The helical shape of the rotor 26 and the helical shape of the recess 36 in the elastomer body 20 of the stator body 18 cooperate to convey the medium to be conveyed since conveyor chambers are formed by the helical shape of the stator body 18 and the rotor 26, which enable a continuous and pulsation-free conveyance of the material to be conveyed by the pump. Due to its helical shape and its eccentric drive, the rotor 26 can contact or also deflect specific portions of the stator body 18 in order to form one or more conveyor chambers.

Since it is often viscous, highly viscous and abrasive media, such as oil, fat and mud-like wastewater, that are conveyed with pumps of this type, a high pressure is exerted onto the stator body 18 during the operation of a feed pump or an eccentric pump. This pressure can be transmitted to the tie rods 16 by deformation of the supporting elements 28, whereby the stator body 18 is prevented from bulging or buckling as well as twisting on account of the pressure of the medium to be conveyed. The medium to be conveyed enters the stator body 18 at the end piece 14 (FIG. 5—right side in the direction of the longitudinal axis L), is conveyed through the stator body 18 by means of the motion of the rotor 26 and flows through the hole 36 out of the stator via the end piece 12 or rather the end piece member 12*a* with its tube like connecting piece (FIG. 5—left side in the direction of the longitudinal axis L).

The rotor 26 comprises a hole 40 for the purpose of fixation to a universal-joint shaft or the like.

Figure 6:
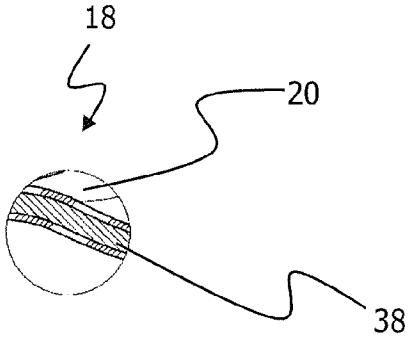
FIG. 6 shows a detail drawing of section V according to FIG. 5.
Figure 7:
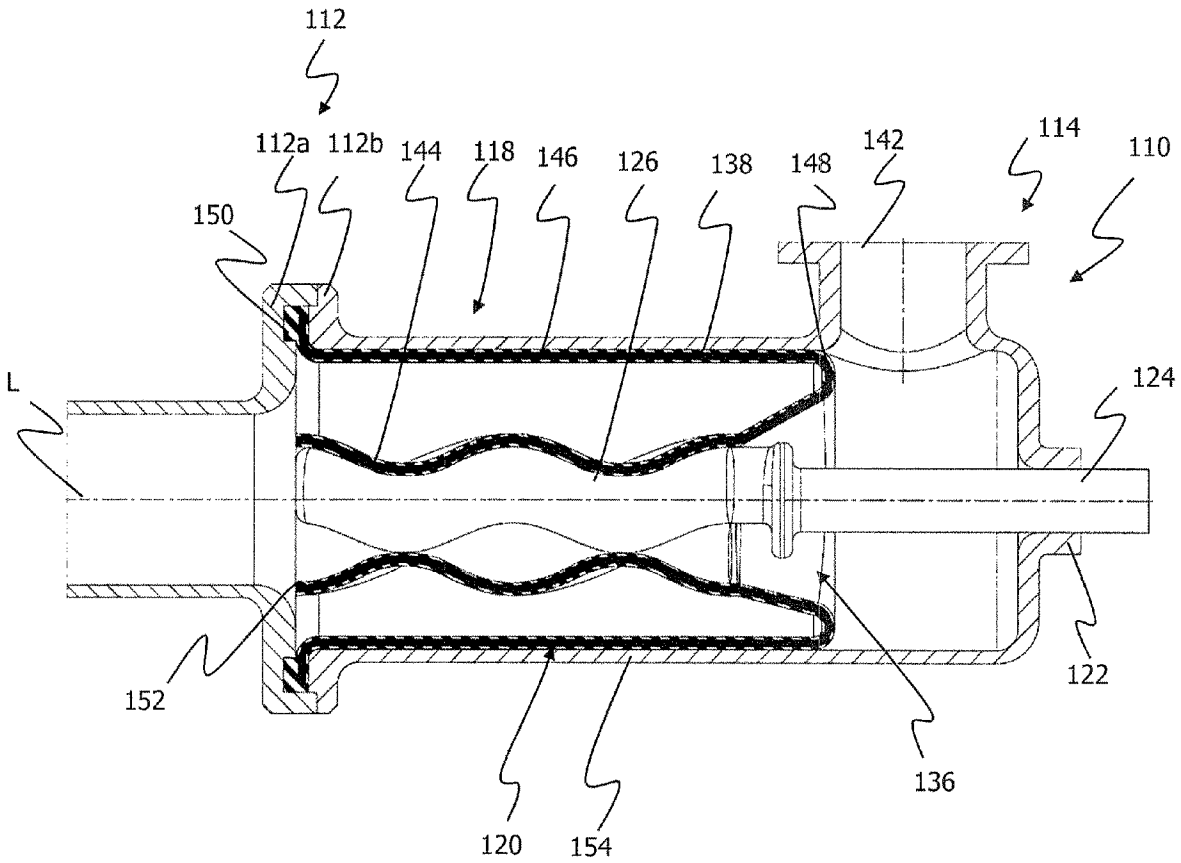
FIG. 7 shows a sectional view of a stator according to a second embodiment of the invention.

FIG. 6 shows a detail view of the detail V of FIG. 5.

This view clearly illustrates the thread inlay 38 which is enclosed in the elastomer of the elastomer body 20 of the stator body 18.

When producing the stator body 18, in contrast to the state of the art, no connection between the elastomer and a metal tube has to be made. In the stator body 18 according to the invention, the thread inlay 38 is embedded in an elastomer body 20 and the elastomer is subsequently vulcanized whereby a connection between the elastomer and the thread inlay is effected.

In the following, a second embodiment of the stator according to the invention is described wherein similar components having the same effect are provided with the same reference signs but prefixed with the figure "1".

The stator 110 according to the second embodiment comprises end pieces 112 and 114. The end piece 114 comprises a hole 142 through which the medium to be conveyed enters the stator 110. The end piece 114 further comprises an accommodation hole 122 which accommodates the end portion 124 of the rotor 126 or in which the end portion 124 of the rotor 126 is supported. The rotor 126 is rotatably supported in the accommodation hole 122 but cannot perform any eccentric motion due to its rigid support in the hole 122. The end portion 124 of the rotor 126 is tubular whereas the portion of the rotor 126 accommodated in the hole 136 of the stator body 118 or of the elastomer body 120 is helical.

In addition to the accommodation portion 144 comprising the hole 136, the stator body 118 comprises a retainer portion 146 which radially surrounds the accommodation portion 144. The accommodation portion 144 and the retainer portion 146 are connected to each other via a connection portion 148. The connection portion 148 extends at an angle to the longitudinal axis L, whereas the accommodation portion 144 and the retainer portion 146 extend in the direction of the longitudinal axis L. The connection portion forms a part of the accommodation hole 136 of the elastomer body 120. A first end 150 of the elastomer body 120 is clamped between the end piece member 112*a* and 112*b* of the end piece 112. The second end 152 of the elastomer body 120 is provided radially inwards of the first end 150 and has no connection to the end pieces 112*a*, 112*b*. The second end 152 and the accommodation portion 144 are movable. The accommodation portion 144 is forced by the rotating rotor 126 to perform an eccentric motion during operation, said eccentric motion being necessary for the pumping step.

The elastomer body 120 comprises the thread inlay 138 which extends completely through the elastomer body 120 and is also seized in the end piece members 112*a* and 112*b*.

The stator 110 comprises a tubular portion 154 which extends between the end pieces 114 and 112. The retainer portion 146 of the elastomer body 120 rests against the tubular portion 154. The connection portion 148 of the elastomer body 120 extends from the retainer portion 146 radially inwards and merges into the accommodation hole 136 and connects the retainer portion 146 to the accommodation portion 144 having a spiral-shaped or helical contour. The accommodation portion 144 accommodates the rotor 126 at least in sections.

The stator 110 according to this embodiment is particularly configured for pumps in which the rotor 126 is rigidly arranged and only rotates around the longitudinal axis L. The rotor 126 cannot perform an eccentric motion. In this type of pump, the eccentric motion necessary for the pumping operation is achieved by the accommodation portion 144 of the stator body 118 which is deflected by the rotating, helical rotor 126 in operation and thus can perform an eccentric motion. The eccentric motion of the deflectable accommodation portion 144 is also made possible on account of the movable end 152 which is not fixed to the stator 110 or the end piece 112. Two conveyor chambers can be formed between the rotor 126 and the accommodation portion 144 by means of the deflectable accommodation portion 144 in order to convey the medium to be conveyed through the stator 110.

In other words, the eccentric motion necessary for the pumping operation is achieved in this type of pumps by the rotary motion of the rotor 126 and the deflection of the accommodation portion 144 of the elastomer body 120 relative to the longitudinal axis L.

What is claimed is:

1. A stator for an eccentric screw pump, the stator comprises:

a stator body, the stator body comprising:

an accommodation hole configured for accommodating a rotor;

a tubular elastomer body reinforced at least in sections with a thread inlay and having an axial first end and an axial second end opposite the axial first end;

a first end piece; and a second end piece, wherein:

the tubular elastomer body forms an outer surface of the stator body;

the first axial end is secured to the first end piece; and the second axial end is secured to the second end piece.

2. The stator according to claim 1, wherein the stator body is helical, and the accommodation hole helically extends through the stator body along the longitudinal axis thereof.

3. The stator according to claim 1, wherein the thread inlay extends in the direction of the longitudinal axis through the stator body.

4. The stator according to claim 3, wherein the thread inlay extends around the longitudinal axis of the stator in the elastomer body in the form of a winding.

5. The stator according to claim 4, wherein the winding of the thread inlay consists of several layers, wherein at least individual layers of the winding are crosswise wound.

6. The stator according to claim 1, further comprising supporting elements provided on the stator body on an outer circumferential surface and distributed along a longitudinal extension of the stator body.

7. The stator according to claim 6, wherein the stator comprises at least one tie rod and the supporting elements provided on the outer circumferential surface of the stator body rest against the at least one tie rod.

8. The stator according to claim 1, wherein the stator comprises at least one tie rod which is connected to the first end piece and the second end piece at axial ends of the stator.

9. An eccentric screw pump comprising a stator according to claim 1.

10. A stator for an eccentric screw pump, the stator comprises:

a stator body, the stator body comprising:

an accommodation hole configured for accommodating a rotor;

an elastomer body reinforced at least in sections with a thread inlay;

one or more supporting elements provided on an outer circumferential surface of the stator body and distributed along a longitudinal extension of the stator body;

at least one tie rod which is connected to end pieces of the stator adjacent axial ends of the stator body; and wherein the one or more supporting elements provided on the outer circumferential surface of the stator body rest against the at least one tie rod.

11. The stator according to claim 10, wherein the stator body is helical, and the accommodation hole helically extends through the stator body along the longitudinal axis thereof.

12. The stator according to claim 10, wherein the thread inlay extends in the direction of the longitudinal axis through the stator body.

13. The stator according to claim 10, wherein the end pieces of the stator are configured such that the axial first end and the axial second end of the stator body are configured to be seized by the end pieces of the stator.

14. A stator for an eccentric screw pump, the stator comprises:

a stator body, the stator body comprising:

an accommodation hole configured for accommodating a rotor, the stator body comprises;

a tubular elastomer body reinforced at least in sections with a thread inlay and having an axial first end and an axial second end;

a plurality of supporting elements provided on the stator body, each supporting element extending from an outer surface of the stator body at a first axial location spaced from a second axial location of at least one other supporting element; and wherein the elastomer body forms an outer surface of the stator body.

15. The stator according to claim 14, wherein the stator comprises at least one tie rod which is connected to end pieces of the stator at adjacent axial ends of the stator body.

16. The stator according to claim 15, wherein the supporting elements provided on the outer circumferential surface of the stator body rest against the at least one tie rod.

* * * * *